US011811166B2

(12) United States Patent
Lara et al.

(10) Patent No.: US 11,811,166 B2
(45) Date of Patent: Nov. 7, 2023

(54) ELECTRICAL CONNECTOR WITH VIBRATION DAMPENER

(71) Applicant: Aptiv Technologies Limited, St. Michael (BB)

(72) Inventors: Roberto Carlos Narro Lara, Satillo (MX); Carlos Ernesto Lopez Campos, Satillo (MX); Eduardo Daniel Alvarez Valdes, Satillo (MX); Jorge Thamer Cardenas, Satillo (MX)

(73) Assignee: Aptiv Technologies (2) S.à r.l., Luxembourg (LU)

( * ) Notice: Subject to any disclaimer, the term of this patent is extended or adjusted under 35 U.S.C. 154(b) by 0 days.

(21) Appl. No.: 17/551,624

(22) Filed: Dec. 15, 2021

(65) Prior Publication Data

US 2023/0178926 A1 Jun. 8, 2023

Related U.S. Application Data

(60) Provisional application No. 63/287,163, filed on Dec. 8, 2021.

(51) Int. Cl.
*H01R 13/533* (2006.01)
*H01R 13/502* (2006.01)
*H01R 24/20* (2011.01)

(52) U.S. Cl.
CPC ..... *H01R 13/533* (2013.01); *H01R 13/5025* (2013.01); *H01R 24/20* (2013.01); *H01R 2201/26* (2013.01)

(58) Field of Classification Search
CPC ..... H01R 13/533; H01R 13/53; H01R 13/56; H01R 13/5825; H01R 13/523; H01R 13/527; H01R 13/5219; H01R 13/5025; H01R 13/52; H01R 13/46; H01R 24/20
USPC ..... 439/384, 578–595
See application file for complete search history.

(56) References Cited

U.S. PATENT DOCUMENTS

| | | | | |
|---|---|---|---|---|
| 10,177,498 | B1 * | 1/2019 | Yi | H01R 13/514 |
| 10,622,755 | B1 | 4/2020 | Gonzalez Delgadillo et al. | |
| 2013/0102176 | A1 * | 4/2013 | Kazubowski | H01R 13/512 439/275 |

FOREIGN PATENT DOCUMENTS

| | | |
|---|---|---|
| DE | 10102137 A1 | 7/2002 |
| EP | 0913888 A2 | 5/1999 |

OTHER PUBLICATIONS

"Extended European Search Report dated Apr. 26, 2023", 10 Pages.

* cited by examiner

*Primary Examiner* — Harshad C Patel
(74) *Attorney, Agent, or Firm* — Billion & Armitage

(57) ABSTRACT

An electrical connector assembly includes an electrical terminal attached to a wire cable, a connector housing defining a cavity in which the electrical terminal is disposed, and a resilient damping element disposed intermediate the electrical terminal and an inner wall of the cavity. The damping element is configured to reduce the amplitude and/or change the frequency of vibratory mechanical energy transmitted to the electrical terminal in the electrical connector through the wire electrical cable attached to the terminal.

16 Claims, 4 Drawing Sheets

ELECTRICAL CONNECTOR WITH VIBRATION DAMPENER

CROSS-REFERENCE TO RELATED APPLICATION

This application claims benefit of priority to U.S. Application No. 63/287,163 filed on Dec. 8, 2021, the entire disclosure of which is hereby incorporated by reference.

This provisional patent application is directed to an electrical connector including vibration damping elements to reduce vibration amplitude and/or change vibration frequency transmitted from a wire cable to an electrical terminal.

BACKGROUND

Automotive electrical connectors are being required to meet new, more stringent, mechanical vibration requirements by automotive manufactures. In electrical connection systems used in motor vehicles, mechanical vibration can be transmitted to an electrical terminal via a wire cable attached to it. In coaxial connection systems, the amplitude of the vibration is too great of if the frequency of the vibration is at or near a resonant frequency of the terminal, the vibration can cause fretting corrosion or wear to the center contacts of the terminal that results in increased electrical resistance and degradation of the signal transmission through the connector.

BRIEF DESCRIPTION OF THE DRAWINGS

The present invention will now be described, by way of example with reference to the accompanying drawings, in which.

DETAILED DESCRIPTION

Vibratory mechanical energy in a mechanical system may be dissipated by the addition of damping elements. The damping elements may also change the frequency of the vibratory mechanical energy in order to avoid a resonant frequency of the mechanical system. An electrical connector system that may be exposed to high vibration profiles is presented herein that includes damping elements to reduce the amplitude and/or change the frequency of vibratory mechanical energy transmitted to an electrical terminal in the connector through a wire electrical cable attached to the terminal to avoid damage to the terminal caused by vibration transmitted through the cable.

Figure 1:
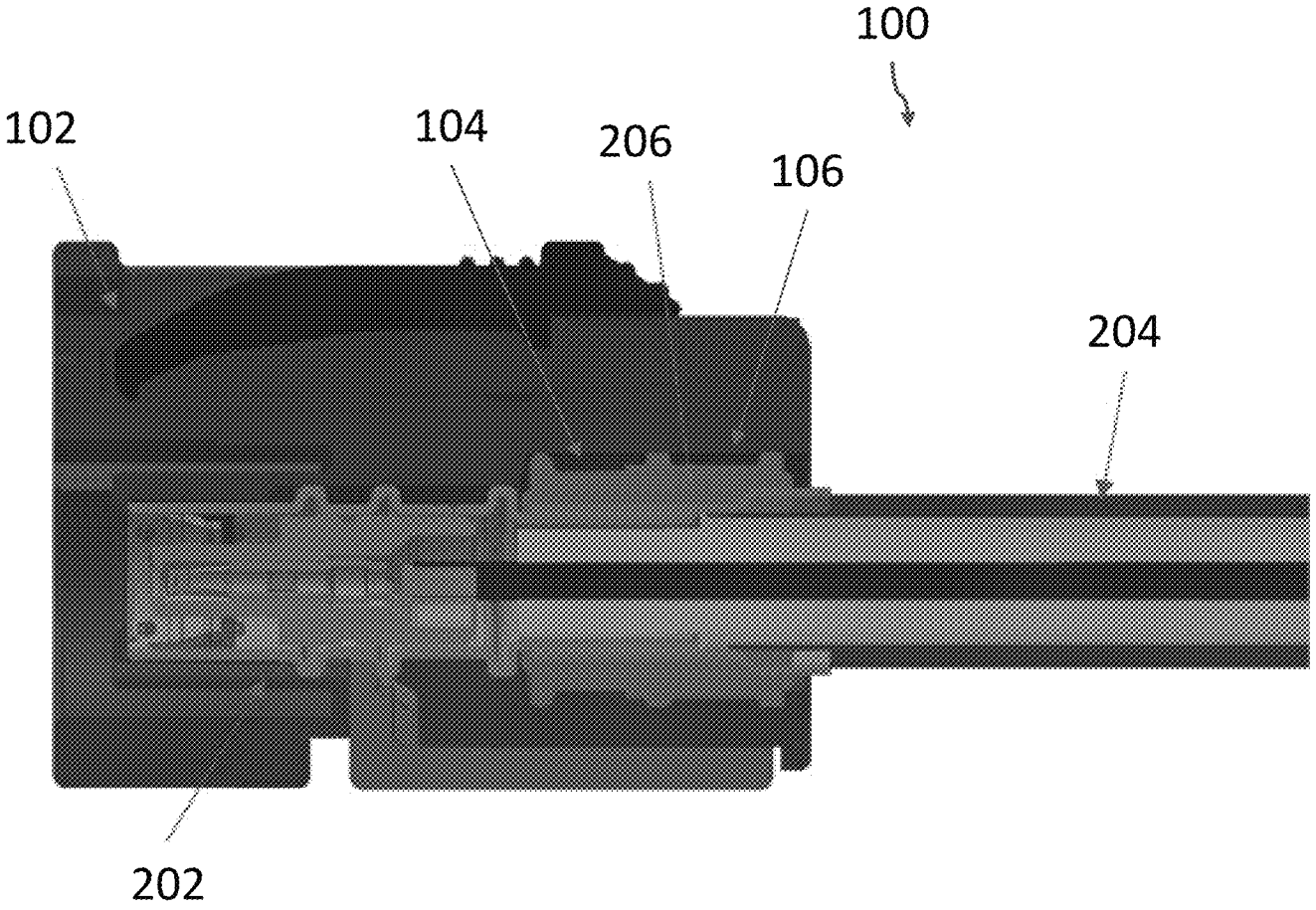
FIG. 1 is a cross section view of an electrical connector assembly in accordance with some embodiments.

FIG. 1 illustrates a non-limiting example of an electrical connector assembly 100 that includes a coaxial electrical terminal 202 attached to a coaxial wire cable 204, a connector housing 102 defining a cavity 104 in which the electrical terminal 202 is disposed, and a resilient damping element 206 that is disposed between the electrical terminal 202 and an inner wall 106 of the cavity 104. The damping element 206 may be formed of an elastomeric material, such as a silicone rubber material. The elastomeric material preferably has a Shore-A hardness value between 40 to 60.

Figure 2:
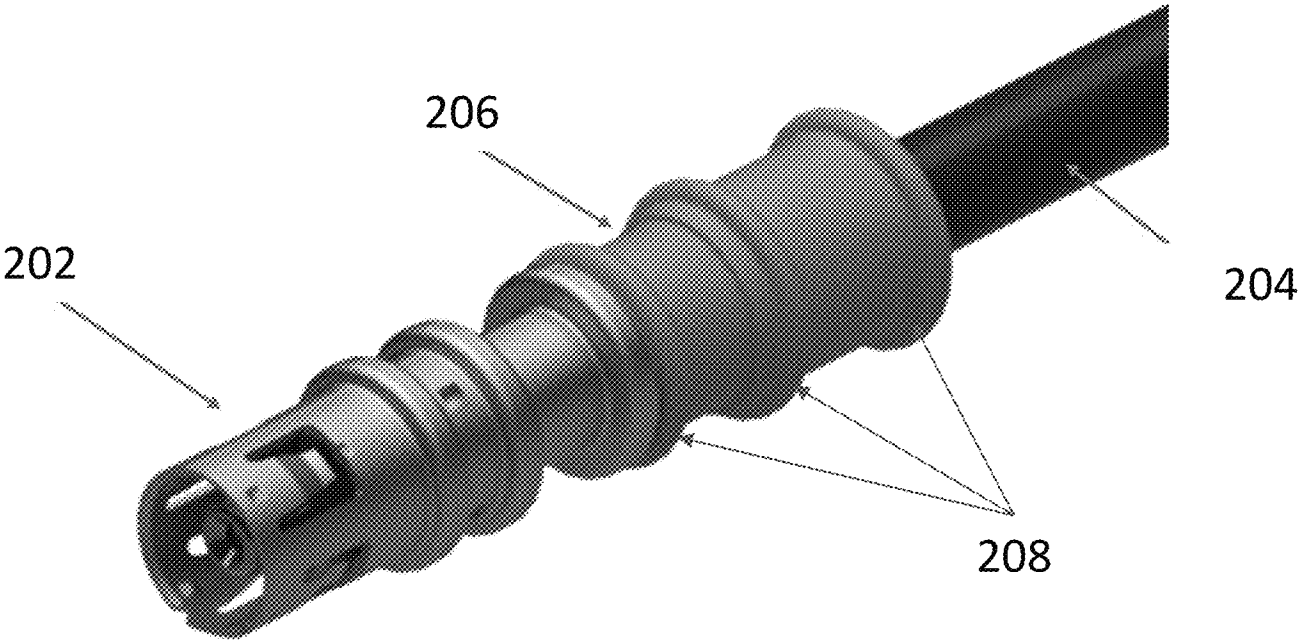
FIG. 2 is a perspective view of a wire cable, electrical terminal, and damping element of the electrical connector assembly of FIGS. 1 and 3 in accordance with some embodiments.

As shown in FIGS. 1 and 2, the damping element 206 surrounds a portion of the electrical terminal 202. The damping element 206 has a cylindrical shape with a bore extending longitudinally through the damping element 206. The portion of the electrical terminal 202 is disposed within the bore. As illustrated in FIG. 2, the damping element 206 defines a plurality of circumferential ribs 208 and these circumferential ribs 208 define the outer surface of the damping element 206. The outer surface of the damping element is in a compressive fit with the inner wall 106 of the cavity 104 and an inner surface of the damping element is in a compressive fit with the portion of the electrical terminal 202. When the damping element 206 is inserted within the cavity 104, the diameter of the outer surface is compressed by 0.3 to 0.8 millimeters by the inner wall 106 of the cavity 104. When the portion of the electrical terminal 202 is inserted within the bore of the damping element 206, the diameter of the bore is expanded by 0.3 to 1.2 millimeters. As shown in FIG. 1, the damping element 206 is not in direct contact with the wire cable 204.

Figure 3:
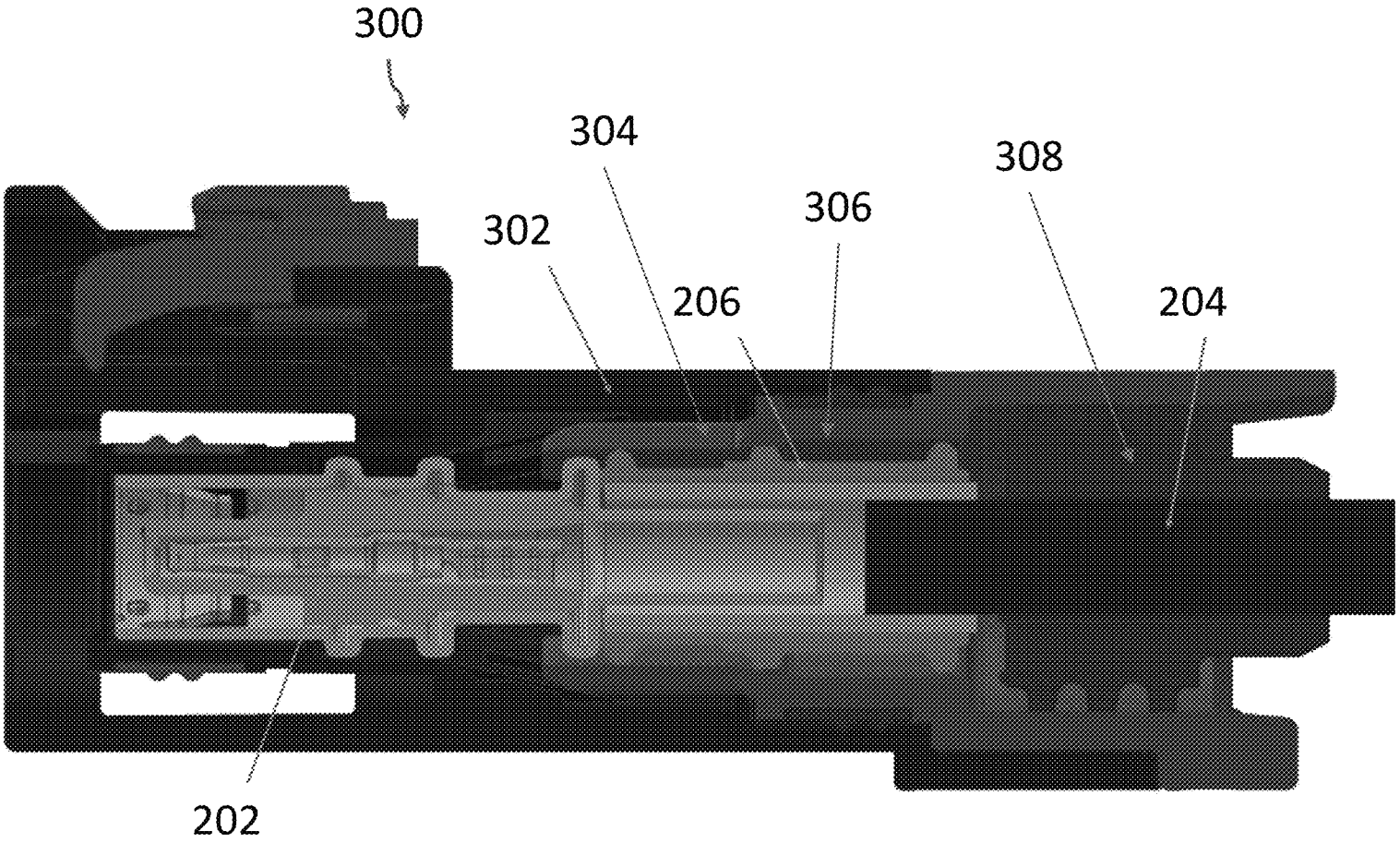
FIG. 3 is a cross section view of an electrical connector assembly in accordance with some embodiments.

FIG. 3 illustrates another non-limiting example of an electrical connector 300 that includes a coaxial electrical terminal 202 attached to a coaxial wire cable 204, a connector housing 302 defining a cavity 304 in which the electrical terminal 202 is disposed, and a resilient damping element 206 that is disposed between the electrical terminal 202 and an inner wall 306 of the cavity 304. The electrical connector 300 is a sealed connector that further includes a cable seal element 308 in addition to the damping element 206. As can be seen in FIG. 3, the cable seal element 308 is separate from the damping element 206. Alternative embodiments may be envisioned in which the damping element is integral with the cable seal element.

The vibration damping properties of the damping element may be controlled by various factors including: the compressive force exerted on the cavity 104, 304 and the terminal 202 by the damping element 206, the hardness of the damping element 206, the height, placement, and number of the circumferential ribs 208, and the length of the damping element 206. These factors may also affect the insertion force required to place the electrical terminal 202 within the damping element 206 and the insertion force required to place the damping element 206 within the cavity 104. 304. This list of factors determining the vibration damping properties of the damping element 206 and insertion forces is not exhaustive.

While the illustrated examples are electrical connectors for coaxial cables, other connector embodiments may be envisioned that are adapted for use with stranded wire cables, solid wire cables, fiber optic cables, pneumatic tubes, hydraulic tubes, or a hybrid connector assembly including two or more of the items listed above.

Figure 4:
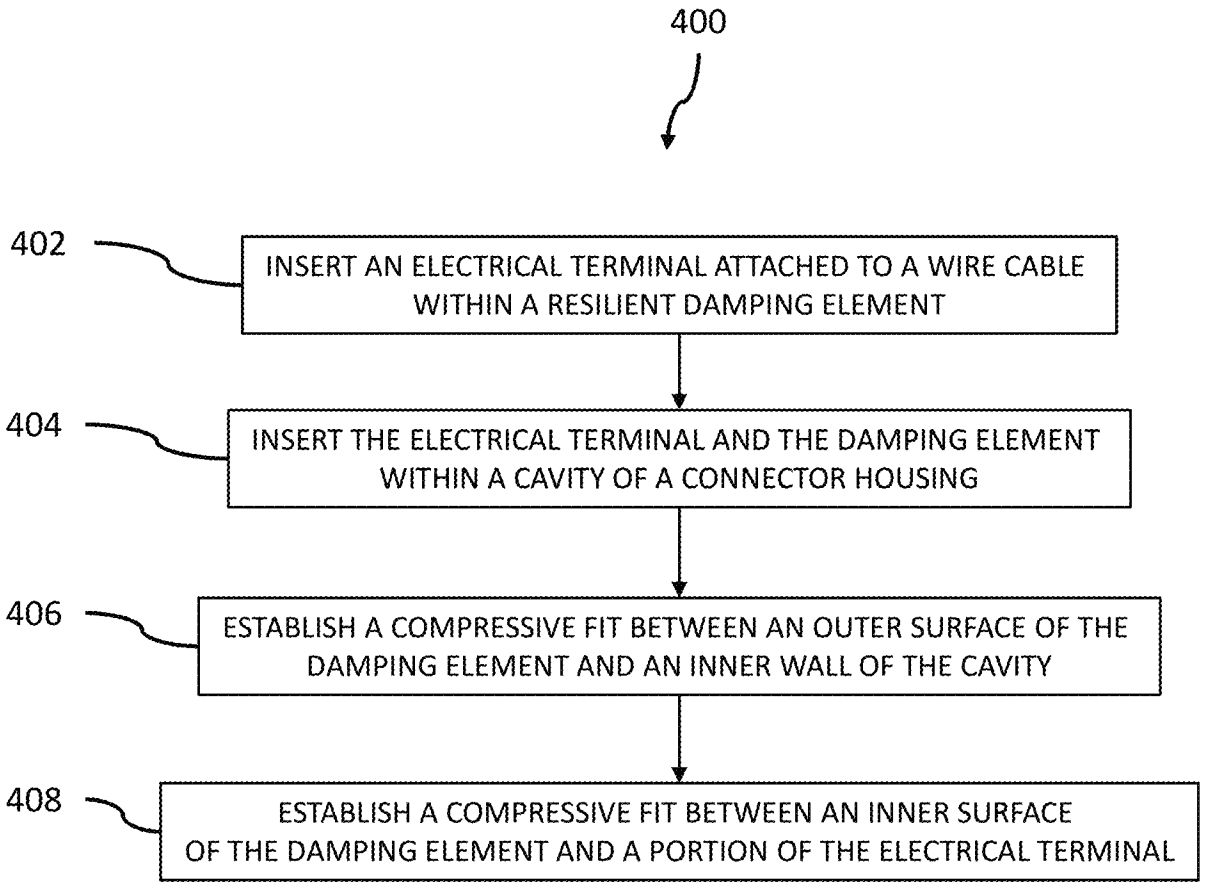
FIG. 4 is a flow chart of a method of assembling an electrical connector in accordance with some embodiments.

FIG. 4 illustrates a method 400 of assembling an electrical connector. This method 400 includes the following steps:

STEP 402, INSERT AN ELECTRICAL TERMINAL ATTACHED TO A WIRE CABLE WITHIN A RESILIENT DAMPING ELEMENT, includes inserting an electrical terminal 202 attached to a wire cable 204 within a resilient damping element 206. The damping element 206 may include an elastomeric material, such as a silicone rubber material having a Shore-A hardness value between 40 to 60. The damping element 206 may have a cylindrical shape with a bore extending longitudinally through the damping element 206. A portion of the electrical terminal 202 may be disposed within the bore. The damping element 206 may define a circumferential rib 208. The circumferential rib 208 may define an outer surface of the damping element 206. The damping element 206 may be arranged so that it is not in direct contact with the wire cable 204;

STEP 404, INSERT THE ELECTRICAL TERMINAL AND THE DAMPING ELEMENT WITHIN A CAVITY OF A CONNECTOR HOUSING, includes inserting the electrical terminal 202 and the damping element 206 within a cavity 104, 304 of a connector housing 102, 302;

STEP 406, ESTABLISH A COMPRESSIVE FIT BETWEEN AN OUTER SURFACE OF THE DAMPING ELEMENT AND AN INNER WALL OF THE CAVITY, includes establishing a compressive fit between an outer surface of the damping element 206 and an inner wall 106, 306 of the cavity 104, 304. A diameter of the outer surface may be compressed by 0.3 to 0.8 millimeters by the inner wall 106, 306 of the cavity 104, 304; and STEP 408, ESTABLISH A COMPRESSIVE FIT BETWEEN AN INNER SURFACE OF THE DAMPING ELEMENT AND A PORTION OF THE ELECTRICAL TERMINAL, includes establishing a compressive fit between an inner surface of the damping element 206 and a portion of the electrical terminal 202. A diameter of the bore may be expanded by 0.3 to 1.2 millimeters by the portion of the electrical terminal 202.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any order of arrangement, order of operations, direction or orientation unless stated otherwise.

The invention claimed is:

1. An electrical connector assembly, comprising:

an electrical terminal attached to a wire cable;

a connector housing defining a cavity in which the electrical terminal is disposed; and a resilient damping element disposed intermediate the electrical terminal and an inner wall of the cavity, wherein the resilient damping element is formed of an elastomeric material having a Shore-A hardness value between 40 to 60 and wherein an outer surface of the damping element is in a compressive fit with the inner wall of the cavity and an inner surface of the damping element is in a compressive fit with a portion of the electrical terminal.

2. The electrical connector assembly in accordance with claim 1, wherein the elastomeric material comprises a silicone rubber material.

3. The electrical connector assembly in accordance with claim 1, wherein the damping element surrounds a portion of the electrical terminal.

4. The electrical connector assembly in accordance with claim 1, wherein the damping element is characterized as having a cylindrical shape with a bore extending longitudinally therethrough and wherein a portion of the electrical terminal is disposed within the bore.

5. The electrical connector assembly in accordance with claim 4, wherein the damping element defines a circumferential rib and wherein the circumferential rib defines the outer surface of the damping element.

6. The electrical connector assembly in accordance with claim 4, wherein a diameter of the outer surface is compressed by 0.3 to 0.8 millimeters by the inner wall of the cavity.

7. The electrical connector assembly in accordance with claim 4, wherein a diameter of the bore is expanded by 0.3 to 1.2 millimeters by the portion of the electrical terminal.

8. The electrical connector assembly in accordance with claim 1, wherein the damping element is not in direct contact with the wire cable.

9. A method of assembling an electrical connector, comprising:

inserting an electrical terminal attached to a wire cable within a resilient damping element formed of an elastomeric material having a Shore-A hardness value between 40 to 60; and inserting the electrical terminal and the damping element within a cavity of a connector housing such that an outer surface of the damping element is in a compressive fit with an inner wall of the cavity and an inner surface of the damping element is in a compressive fit with a portion of the electrical terminal.

10. The method in accordance with claim 9, wherein the elastomeric material comprises a silicone rubber material.

11. The method in accordance with claim 9, further comprising:

establishing a compressive fit between an outer surface of the damping element and an inner wall of the cavity; and establishing a compressive fit between an inner surface of the damping element and a portion of the electrical terminal.

12. The method in accordance with claim 11, wherein the damping element has a cylindrical shape with a bore extending longitudinally therethrough and wherein a portion of the electrical terminal is disposed within the bore.

13. The method in accordance with claim 12, wherein the damping element defines a circumferential rib and wherein the circumferential rib defines an outer surface of the damping element.

14. The method in accordance with claim 13, wherein a diameter of the outer surface is compressed by 0.3 to 0.8 millimeters by the inner wall of the cavity and a diameter of the bore is expanded by 0.3 to 1.2 millimeters by the portion of the electrical terminal.

15. The method in accordance with claim 9, wherein the damping element is not in direct contact with the wire cable.

16. An electrical connector, comprising:

an electrical terminal attached to a wire cable;

a connector housing defining a cavity in which the electrical terminal is disposed; and means for damping vibration transmitted from the wire cable to the electrical terminal, wherein the means is formed of an elastomeric material having a Shore-A hardness value between 40 to 60 and wherein an outer surface of the means is in a compressive fit with an inner wall of the cavity and an inner surface of the means is in a compressive fit with a portion of the electrical terminal.

* * * * *